US005915833A

United States Patent [19]

Kruse

[11] Patent Number: 5,915,833

[45] Date of Patent: Jun. 29, 1999

[54] METHOD AND DEVICE FOR COOLING FOUNDRY SAND

[75] Inventor: Ernst Otto Kruse, Gottmadingen, Germany

[73] Assignee: Maschinenfabrik Gustav Eirich, Germany

[21] Appl. No.: 08/620,366

[22] Filed: Mar. 22, 1996

[30] Foreign Application Priority Data

Apr. 4, 1995 [DE] Germany ..... 195 12 593

[51] Int. Cl.[6] ..... B28C 5/46

[52] U.S. Cl. ..... 366/7; 366/22; 366/40; 366/139; 62/100

[58] Field of Search ..... 366/7, 4, 22, 144, 366/163.1, 139, 40; 62/100; 241/DIG. 10

[56] References Cited

U.S. PATENT DOCUMENTS

| | | | |
|---|---|---|---|
| 2,585,739 | 2/1952 | Christian | 366/144 |
| 4,252,001 | 2/1981 | Musschoot | 62/216 |
| 4,361,405 | 11/1982 | Wedek et al. | 366/139 |
| 4,611,469 | 9/1986 | Musschoot | 62/100 |
| 5,279,741 | 1/1994 | Schott | 241/DIG. 10 |

FOREIGN PATENT DOCUMENTS

| | | |
|---|---|---|
| 1219182 | 6/1966 | Germany . |
| 3006552 | 2/1981 | Germany . |

OTHER PUBLICATIONS

European search report from corresponding European prosecution dated Mar. 4, 1997.

Blatz J. Formsandkuhlung unter Vakuum. Giesserei 79(1992) No.:15, 628–635 (English translation provided).

*Primary Examiner*—Tony G. Soohoo

*Attorney, Agent, or Firm*—Paul & Paul

[57] ABSTRACT

A cooling apparatus for used foundry sand provided with a homogenizing and conveying apparatus in a constant vacuum with controlled water inflow and a suction point for the water vapor, the water evaporating due to the reduced pressure draws the heat of evaporation from the sand, the apparatus having a condenser in which the vapor condenses into water which is cooled and re-used, and coupled locks provided on the inlet and outlet of the conveying apparatus, through which the sand enters and leaves the reduced pressure area.

8 Claims, 2 Drawing Sheets

METHOD AND DEVICE FOR COOLING FOUNDRY SAND

BACKGROUND OF THE INVENTION

1. Field of Invention

The present invention relates to methods and devices for molding cast parts and more particularly for the cooling of foundry sand in connection with the molding process.

2. Brief Description of the Prior Art

In the manufacture of cast iron parts the patterns for the cast parts are molded under high pressure in sand molds and molten iron is poured into the hollow spaces. After solidification of the iron the cast parts are removed from the mold and the foundry sand is prepared and used again for producing a mold. Through contact with the molten metal the foundry sand has become very hot in places so that cooling is imperative before re-use.

Various methods are known for cooling used sand.

Among the most common methods is the breaking up and flowing through of the sand with air. For this, extremely large-sized devices with very large operational capacity are needed for cooling down the very unevenly heated sand particles to a useable temperature. The heated cooling air is mixed with dust and has to be cleaned in large volume dust extraction installation. The disadvantages of this method are the large space and energy requirements.

In OS 30 06 552 a cooling apparatus is described wherein 2 containers are alternately filled with wetted hot used sand and then placed in a vacuum. The moisture in the sand evaporates and draws the heat of evaporation from the sand. It is disadvantageous with this method that the intermittent operation requires 2 evacuating containers and the vacuum in the very large containers must be constantly produced and terminated. The energy costs and space requirements of such an installation are therefore very considerable.

A foundry sand mixer is described in P 29 52 403, the mixing area of which is evacuated during the mixing process so that in this case also, evaporation heat is dissipated. In this method too, the proportion of evacuation volume to the quantity of sand is very unfavourable, as in this case also the vacuum has to be produced and terminated with each mixing cycle. The normal mixing cycle must, in addition, be significantly lengthened so that here again, energy and investment costs work out unfavorably.

SUMMARY OF THE INVENTION

The object of the present invention is to provide an apparatus which avoids the disadvantages previously described and is thereby inexpensive as well as space and energy saving.

To this end, according to the invention a mixing and conveying apparatus is proposed. The hot sand is wetted as required and conveyed continuously through the device. By means of the mixing effect of the feed screw the added water is mixed intensively with the sand. The mixing and conveying apparatus is constantly in a vacuum. The water evaporates and draws the heat of the evaporation from the sand. The vapor is suctioned off and condensed. The water produced is cooled down again and used again for wetting the sand. Coupled locks are connected at the inlet and outlet ends to maintain the vacuum in the mixing and conveying apparatus.

BRIEF DESCRIPTION OF THE DRAWING FIGURES

DETAILED DESCRIPTION OF THE PREFERRED EMBODIMENTS

Operation

Figure 1:
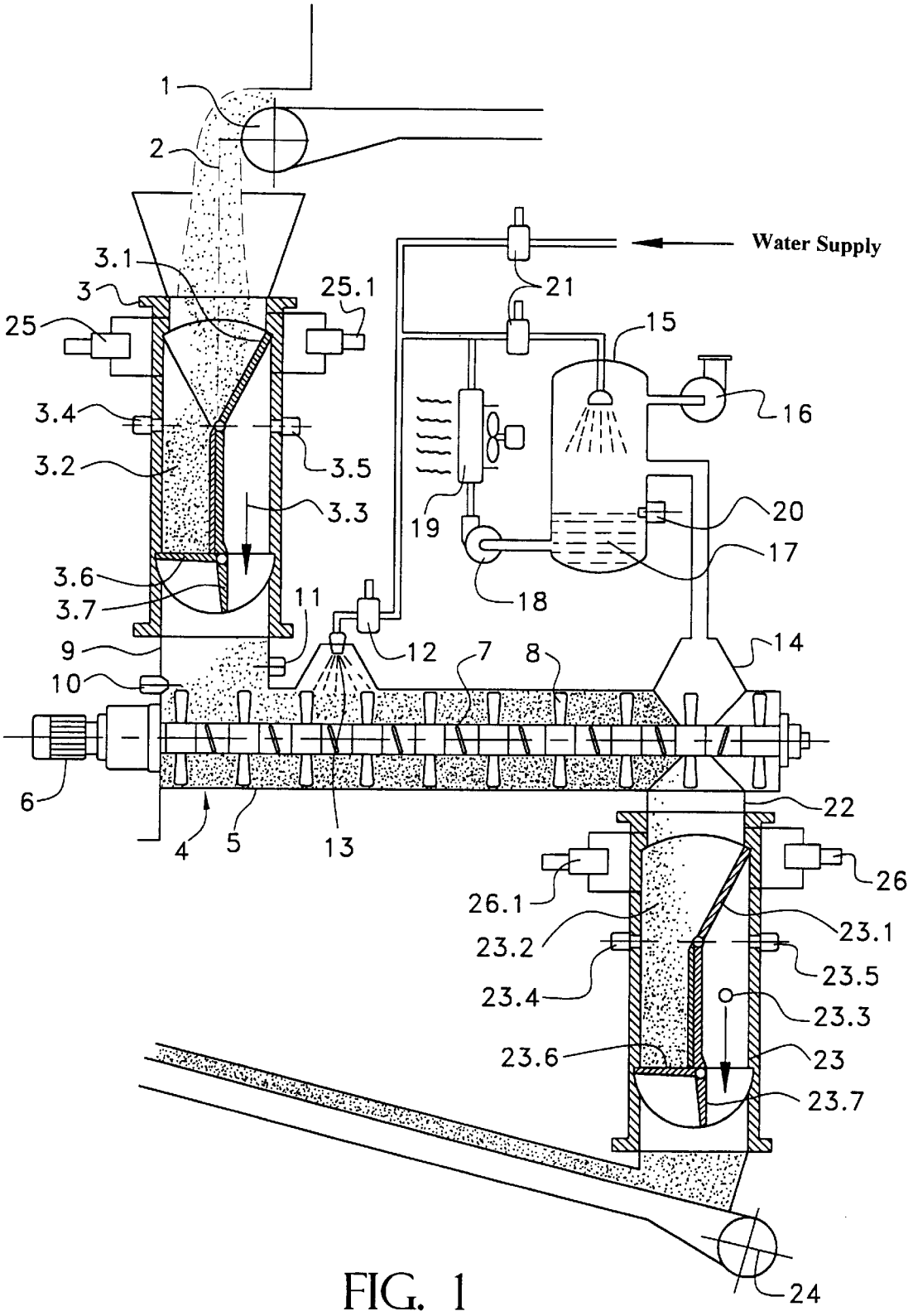
FIG. 1 is a front elevation, partial sectional view of an apparatus according to the present invention, showing the method of the invention being practiced.

The hot sand 2 is conveyed from a conveyor belt 1 into the lock 3. An air-tight sealing motor driven switch-over flap 3.1 guides the sand into the left-hand lock chamber 3.2 which is also closed at the bottom by a motor driven and air-tight sealing flap 3.6. When the contents have risen far enough to reach the sensor 3.4, the flap 3.7 automatically closes. Now the pressure equalizing valve 25.1 opens for a few seconds. Directly afterwards the flap 3.1 is automatically pivoted to the left so that thereafter the right-hand chamber 3.3 is filled. After the switching over of the flap 3.1, the lower flap 3.6 is opened so that the sand passes from the chamber 3.2 into the mixing and conveying apparatus 4 and thereby into the evacuated space.

When the right-hand chamber 3.3 shows, by means of reaction of the sensor 3.5, that it is filled, the lower flap 3.6 firstly closes and then the pressure equalizing valve 25 opens briefly and the flap 3.1 again pivots into the right-hand position so that now, again, the left-hand chamber 3.2 is filled and simultaneously the right-hand one 3.3 is emptied downwards.

By means of the constantly repeated automatic emptying of the coupled locks described above, the hot sand reaches the evacuated mixing and conveying apparatus 4, wherein—as a particular feature of the present invention—in said apparatus a vacuum is constantly maintained.

The mixing and cooling apparatus 4 is composed, for example, of a tubular housing 5 in the central axis of which a shaft 7 driven by a motor 6 rotates, which is fitted with the paddles 8 inclined predominantly in the direction of conveyance. Sensors for sensing the temperature 10 and the residual moisture of the sand 11 are arranged in the inlet nozzle 9. The temperature and the residual moisture are evaluated in a computer and the result of this used for controlling the control valve 12 for the water inflow 13.

The water vapor produced because of the reduced pressure is suctioned through the suction nozzle 14 into the condenser 15 which is kept continuously at a reduced pressure of 10–15 Torr by a vacuum pump 16. The condensed water 17 is partly returned to the condenser by a circulating pump 18 through a cooler 19, and partly used for wetting the sand. A level sensor 20 controls the water level 17. Regulating valves 12 and 21 control the amount of water currently required, partly circulating, partly with addition of fresh water from the mains.

At the end of the conveyor tube 5 is the outlet nozzle 22 to which a second coupled lock 23 is connected in an air-tight manner. This lock 23 is constructed identically to the lock 3 on the intake nozzle 9.

The cooled sand falls into the left-hand chamber 23.2 while the right-hand chamber 23.3 is emptied through the lower flap 23.7 onto a conveyor belt 24. If the sensor 23.4 is reached by the sand the lower flap 23.7 closes, the pressure equalizing valve 26 opens for a few seconds and the switch-over flap 23.1 pivots to the left so that now the right-hand chamber 23.3 is filled. Then, the pressure equalizing valve 26.1 firstly opens and then the lower flap 23.6 so that the sand falls onto the conveyor belt 24. This lock also operates, continuously alternating, completely automatically.

Figure 2:
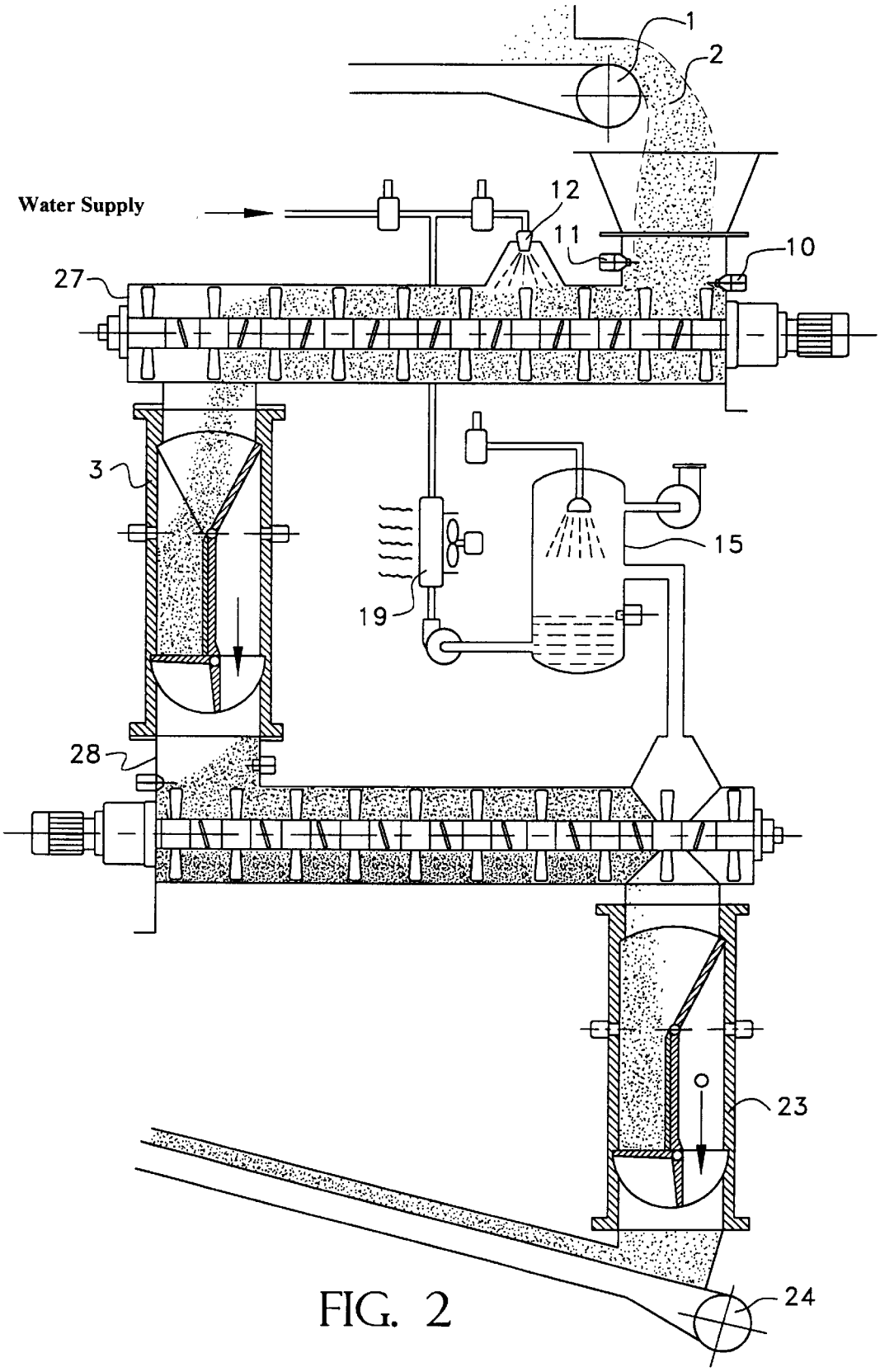
FIG. 2 is a front elevation, partial sectional view of an alternate embodiment of an apparatus according to the present invention, showing the method of the invention being practiced.

The present invention is not limited to the embodiment described. It also takes into consideration inter alia an embodiment according to FIG. 2, in which 2 mixing and conveying apparatuses are provided. In the first mixing and conveying apparatus 27 the hot sand is wetted and homogenized and in this state passes through the coupled lock 3 to the second mixing and conveying apparatus 28, which is continuously in a vacuum in the manner previously described. The evaporation heat is fed to the condenser 15 in the manner described, the condensed water cooled again in the cooler and re-used.

The method according to the invention is thus distinguished by 1. wetting according to need
2. intensive homogenization of the unevenly heated sand with the water
3. low dead volume of the spaces to be evacuated
4. low energy consumption
5. small space requirement
6. even temperature and residual moisture of the cooled sand.

I claim:

1. A method for cooling and homogenizing foundry sand in a continuously operating mixing and conveying apparatus, the method comprising mixing hot foundry sand with water, the foundry sand being continuously mixed and conveyed in a vacuum produced by a vacuum pump, the method further comprising automatically operating locks provided on the inlet and outlet of the mixing and conveying apparatus to ensure maintenance of the vacuum, the method further comprising controlling the amount of the water supplied for mixing with the hot foundry sand by means of at least one temperature sensor and at least one moisture sensor within the inlet area of the housing, including evaluating the temperature and moisture, respectively, sensed by said at least one temperature sensor and said at least one moisture sensor, by means of a computer and thereby ensuring even temperature and residual moisture.

2. A method according to claim 1 further comprising condensing water vaporized from the foundry sand back into liquid water in a condenser, recooling this water, and using this water again for wetting the sand.

3. A method according to claim 2, the foundry sand being wetted and homogenized in a first mixing and conveying apparatus only, and continuously mixed and conveyed in a vacuum in a second mixing and conveying apparatus, the evaporation heat being removed from said second mixing and conveying apparatus.

4. A method according to claim 1, the foundry sand being wetted and homogenized in a first mixing and conveying apparatus only, and continuously mixed and conveyed in a vacuum in a second mixing and conveying apparatus, the evaporation heat being removed from said second mixing and conveying apparatus.

5. A device for cooling and homogenizing foundry sand in a continuously operating mixing and conveying apparatus, the device including coupled locks, each lock being provided with one switch-over flap and two outlet flaps, the device further comprising means for maintaining said foundry sand in a vacuum environment, said means including a vacuum pump; control means for controlling the amount of water supplied for mixing with the hot foundry sand, said control means comprising at least one temperature sensor disposed within the inlet of the housing and at least one moisture sensor disposed within the inlet of the housing; computer means for evaluating the temperature and moisture sensed with the temperature and moisture sensors, respectively, and valve means controlled by said computer means for controlling the water inflow.

6. A device according to claim 5, further comprising filling level sensors.

7. A device according to claim 5, further comprising pressure equalizing valves.

8. A method for cooling and homogenizing foundry sand in a continuously operating mixing and conveying apparatus, the method comprising mixing hot foundry sand with water, the foundry sand being continuously mixed and conveyed in a vacuum produced by a vacuum pump, the foundry sand being wetted and homogenized in a first mixing and conveying apparatus only, and continuously mixed and conveyed in a vacuum in a second mixing and conveying apparatus, the evaporation heat being removed from the foundry sand in said second mixing and conveying apparatus, the method further comprising controlling the amount of the water supplied for mixing with the hot foundry sand by means of at least one temperature sensor and at least one moisture sensor within the inlet area of the housing, including evaluating the temperature and moisture, respectively, sensed by said at least one temperature sensor and said at least one moisture sensor, by means of a computer and thereby ensuring even temperature and residual moisture.

* * * * *